United States Patent [19]

Binasik et al.

[11] Patent Number: 4,685,882

[45] Date of Patent: Aug. 11, 1987

[54] PULVERIZED FUEL SLURRY BURNER AND METHOD OF OPERATING SAME

[75] Inventors: Chester S. Binasik, Palo Alto; Steve B. Londerville, Half Moon Bay, both of Calif.

[73] Assignee: Coen Company, Inc., Burlingame, Calif.

[21] Appl. No.: 774,207

[22] Filed: Sep. 9, 1985

[51] Int. Cl.[4] ..... F23M 9/00

[52] U.S. Cl. ..... 431/182; 431/190; 431/354

[58] Field of Search ..... 431/354, 182, 185, 190, 431/201, 252, 9, 8, 252; 239/405, 400, 403, 404, 405, 406; 110/347

[56] References Cited

U.S. PATENT DOCUMENTS 4,473,185 9/1984 Peterson et al. ..... 431/9

FOREIGN PATENT DOCUMENTS 14017 1/1985 Japan ..... 431/9

*Primary Examiner*—Henry A. Bennet

*Attorney, Agent, or Firm*—Townsend & Townsend

[57] ABSTRACT

A burner especially adapted for use with pulverized fuel slurries, such as pulverized coal-water slurries. The burner has an atomizing nozzle which disperses the slurry in the form of multiple, diverging spray cones issuing from a corresponding number of atomizing orifices. Each orifice is formed by a central atomizing air flow. The slurry is brought into contact with the air flow and is atomized thereby. Before the atomized air flow is discharged, it is enveloped by a rotating auxiliary air flow and constricted to generate a venturi effect which facilitates the formation of the diverging, cone-shaped discharge pattern. A combustion air spinner surrounds the nozzle and is constructed of multiple vanes which have circularly arcuate shapes and a length, in the direction of the air flow, which is least proximate the nozzle and greatest at the periphery of the vanes. This assures an even combustion air flow rate over the entire radial extent of the spinner.

27 Claims, 4 Drawing Figures

PULVERIZED FUEL SLURRY BURNER AND METHOD OF OPERATING SAME

BACKGROUND OF THE INVENTION

Pulverized fuel slurries, such as pulverized coal-water slurries, are easily transported, stored and handled and, therefore, have found increasing use. The combustion of such slurries, however, presents problems because they contain significant amounts of liquids, in the case of coal-water slurries they contain up to 30% (by weight) water. Before combustion can commence, the water must be vaporized. This requires a significant amount of heat which must be quickly transferred to the slurry particles to initiate and sustain combustion.

The remainder of this application will primarily discuss and describe coal-water slurries. However, the invention is not so limited. It is equally useful for other slurries such as, for example, coal-methanol slurries, coal-methanol-water slurries, or coal-oil slurries, to name a few. The term "pulverized fuel slurry", therefore, is meant and should be understood to include all slurries made up of pulverized solid fuels suspended in a liquid.

In addition, the term "pulverized fuel slurry" refers to a slurry or slurries which may contain certain additives to change the viscosity of the slurry, maintain the solid particles in suspension, etc.

It is conventional to fire pulverized fuel slurries (hereinafter sometimes also referred to as "slurry" or "slurries") by atomizing them, that is by finely dispersing the solids-liquid particles into a combustion chamber and, thereafter, igniting them. A problem typically encountered during the atomization of such slurries is that the atomized particles have a tendency to agglomerate, that is to stick to each other when impacted in either the slurry atomizer or the combustion chamber downstream thereof. Once agglomerated, they are virtually impossible to separate.

Agglomerated particles have an increased mass which renders it more difficult to maintain them suspended in the combustion chamber. As a result, they can fall out without complete combustion, foul furnace surfaces and reduce the overall efficiency of the burner. Even if the agglomerated particles do not fall out, they require significantly longer stay times in the flame zone of the combustion chamber before they are completely burnt. Frequently, such extended stay times are not available, particularly in furnaces converted from oil or gas operation to slurry operation.

A further problem associated with slurry burners is the need for the rapid transfer of significant amounts of heat to the atomized slurry particles immediately downstream of the nozzle to initiate combustion. For example, gas burners require the transfer of approximately 1% of the total heat release of the burner to the incoming gas to generate a self-sustaining flame. Oil burners require about 1.5% and pulverized coal burners approximately 2% of the total heat to sustain the flame. In contrast, pulverized coal slurries with a water content of approximately 30% require the transfer of approximately 5% of the total heat release to generate a self-sustaining flame.

The heat required to evaporate the water is obtained from the main combustion chamber and the surrounding furnace walls. The heat transfer is enhanced by generating a low pressure core zone about the burner axis downstream of the nozzle which draws hot combustion gases rearwardly into a "recirculation zone." The prior art accomplished this by employing combustion air spinners which surround the nozzle and which spin the air at a more or less uniform rate over the entire radial extent of the spinner. The result of such a construction is that a low pressure zone is created at the center of the spinner which extends upstream into the spinner so that most of the air is emitted by the spinner at the peripheral portion thereof. A problem encountered with such prior art spinners is that the low pressure zone typically extends along the burner axis rearwardly to and past the nozzle, a problem which increases as the spin number is increased. As a result, recirculation gases contact the nozzle, often unacceptably heat it, and cause a fouling thereof which leads to inefficiencies, possible flame-outs and, in turn, substantial burner downtimes.

The heating of the atomized slurry particles is enhanced by widely dispersing them as, for example, by providing the nozzle with a large number of atomizing orifices. This is difficult to implement with slurry nozzles, as contrasted with oil atomizing nozzles, for example, because the relatively large solid particle sizes (typically in the range of between 0.003" to as large as 0.010") require relatively large orifice diameters and because the abrasive characteristics of solid fuel particles require the use of special, abrasion resistant material inserts, which limit the number of orifices which can be placed in the nozzle. Thus, there can only be a limited number of orifices, which must accommodate relatively large slurry flow rates. This increases the particle concentration in the atomized slurry cone downstream of the nozzle and thereby enhances the incidence of undesirable particle agglomeration.

Thus, there is at the present a need for an efficient slurry burner which achieves a self-sustaining flame without undue stay times for the atomized slurry particles and without fouling burner and furnace walls so that such burners can be used as a substitute for gas, oil and pulverized fuel burners in existing furnaces, for example.

SUMMARY OF THE INVENTION

The present invention provides a slurry burner which is efficient, relatively low in initial and operating costs, and which prevents the fouling of furnace and burner surfaces which surround the flame. Its characteristics are such that it can replace oil, gas or pulverized fuel burners in existing furnaces without compromising efficiency.

Broadly speaking, a first aspect of the present invention contemplates the provision of a slurry atomizing nozzle constructed so that nozzle surfaces are protected from abrasion by solid fuel particles which pass through the nozzle. The atomized slurry is dispersed from the nozzle in a wide-angle cone-like pattern (with an angle which is preferably in the range of between about 12° to 35°) from multiple orifices which are angularly inclined relative to the burner axis and, preferably, relative to each other. Additionally, the nozzle is constructed so that the angle of the conical discharge pattern for the atomized slurry can be regulated to take into account differing operating requirements, furnace loads and the like.

A second aspect of the present invention provides that incoming combustion air flows through an air spinner which concentrically surrounds the atomizing nozzle and which is constructed so that the air flow rate is substantially constant over the entire radial extent of the spinner on the discharge side thereof and at spin numbers which are least in the vicinity of the atomizing nozzle and greatest at the periphery of the spinner. This provides a twofold benefit.

First, the relatively large increase in the spin number between the center of the spinner and the periphery thereof expands the air flow downstream of the spinner because it generates a pressure gradient downstream of the spinner and radially outward of the burner axis. The pressure gradient draws the air flow at the center portion of the spinner shortly after it leaves the spinner in a radially outward direction as it propagates downstream. This promotes the rearward (or upstream) recirculation of hot combustion gases along the burner axis from the combustion chamber towards the nozzle.

The recirculating hot combustion gases greatly increase the rate at which heat is transferred to the atomized slurry particles (consisting of both solid fuel particles and liquid). Thus, combustion can commence only a short distance downstream of the nozzle.

Secondly, contact between the recirculating combustion gases and the nozzle is prevented by the relatively high air flow rate through the spinner at the center thereof, that is adjacent the nozzle, a feature not present in conventional spinners which have constant spin numbers over their entire radial extent. The fouling of the nozzle from recirculating combustion gases is thereby prevented.

Thus, a burner constructed in accordance with the present invention can be used in newly built furnaces or as a replacement for oil, gas or pulverized fuel burners in existing furnaces because heat is rapidly transferred to the atomized slurry and the incidence of undesirable particle agglomeration is greatly reduced. As a result, burner efficiency can be maintained while the combustion chamber size typically need not be significantly larger than what is necessary for gas or oil fired burners.

DESCRIPTION OF THE PREFERRED EMBODIMENTS

Figure 1:
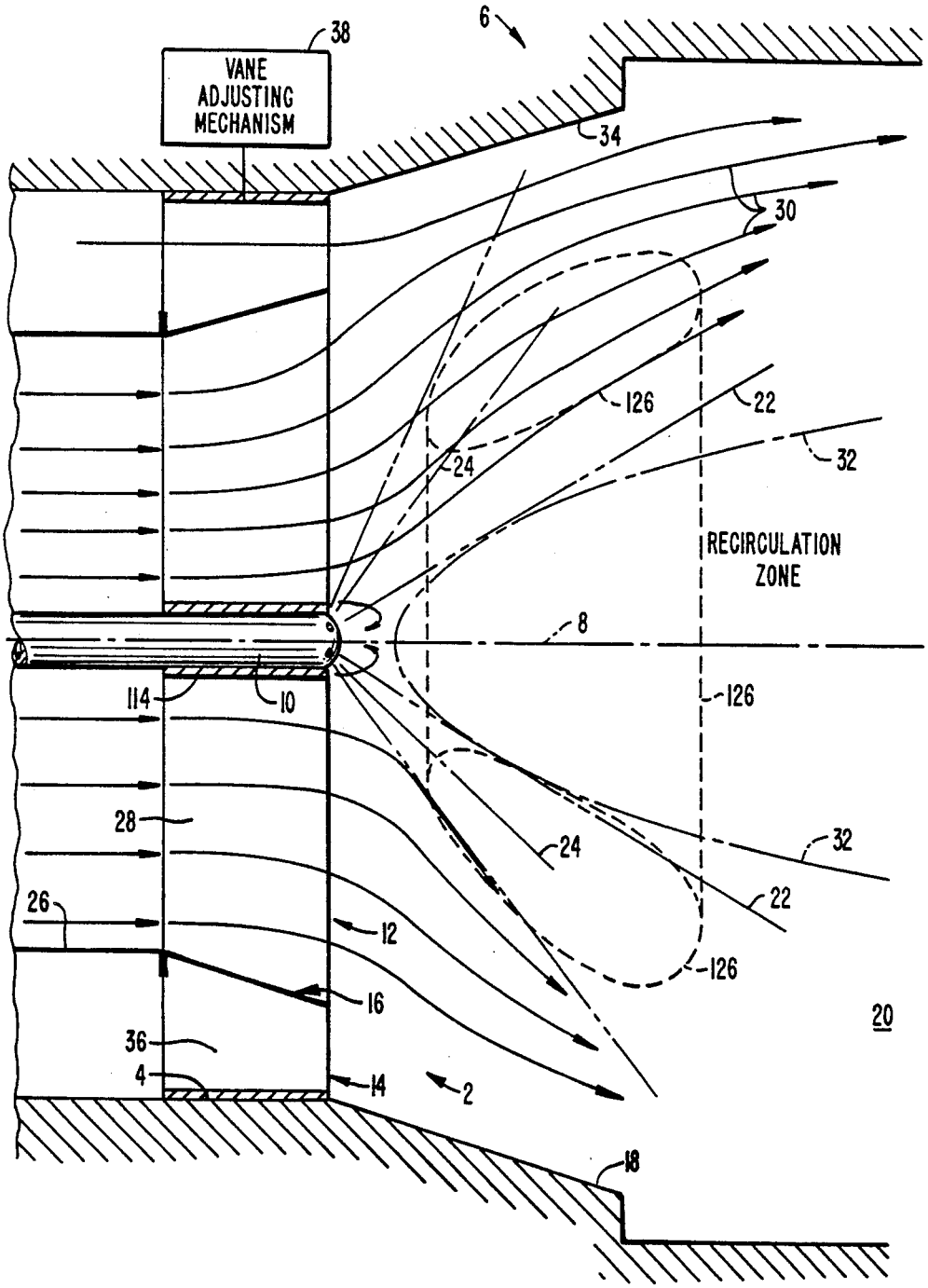
FIG. 1 is a schematic, side elevational view of a solid fuel slurry burner constructed in accordance with the invention.

Referring first to FIG. 1, a pulverized solid fuel slurry burner 2 constructed in accordance with the present invention is installed in a burner opening 4 of a furnace 6. The burner has an axis 8 and includes a slurry atomizing nozzle 10 and a coaxial combustion air spinner 12 which surrounds the nozzle. A secondary combustion air register 14 is coaxially disposed about the spinner and is separated therefrom by a cone 16.

In operation slurry is "atomized," that is the slurry is dispersed into fine slurry particles and discharged from the downstream facing end of the nozzle into a burner throat 18 and hence into a combustion chamber 20 of the furnace. As will be described in greater detail below, the atomized slurry is sprayed into the furnace in the form of a plurality of slurry spray cones 22, the axes 24 of which are angularly inclined relative to the burner axis 8. Primary combustion air flows through an air intake duct 26 from an appropriate source (not shown) to and through the spinner. The spinner has a multiplicity of air deflection vanes 28 which impart a rotary flow component to the combustion air so that it expands radially outward downstream of the spinner as is generally illustrated by primary combustion air flow lines 30.

The swirling combustion air creates a low pressure recirculation zone 32 downstream of the burner which, during firing, recirculates hot combustion gases from the combustion chamber rearwardly (in an upstream direction) as is generally illustrated by the elliptical line in FIG. 1. Slurry particles atomized by nozzle 10 are heated with radiant heat from the hot gases in the recirculation zone as well as from the hot walls 34 of the furnace surrounding the burner throat and the combustion chamber. As the particles are heated the liquid, e.g. water, is evaporated and the temperature of the remaining solids continues to rise to and above the flash point when ignition takes place and the flame becomes self-sustaining.

To prevent the swirling primary combustion air downstream of the burner and the slurry particles discharged by the nozzle from contacting or impacting on furnace walls 34 secondary combustion air is introduced through register 14. It envelopes the primary air and atomized slurry mixture and prevents undesirable contact thereof with the walls and a possible fouling and/or abrasion thereof. Preferably, the secondary combustion air register includes a multiplicity of vanes 36 which are operatively connected with a suitable vane adjusting mechanism 38 for varying the angularity of the vanes relative to the air flow. In this manner the secondary air flow can be adjusted to counter the rotation of the primary combustion air, for example, to restrict the extent to which the latter expands downstream of the burner which facilitates the operation of the burner under reduced load. The construction of such vane adjusting mechanisms is well known and, therefore, is not further shown or described herein.

Figure 2:
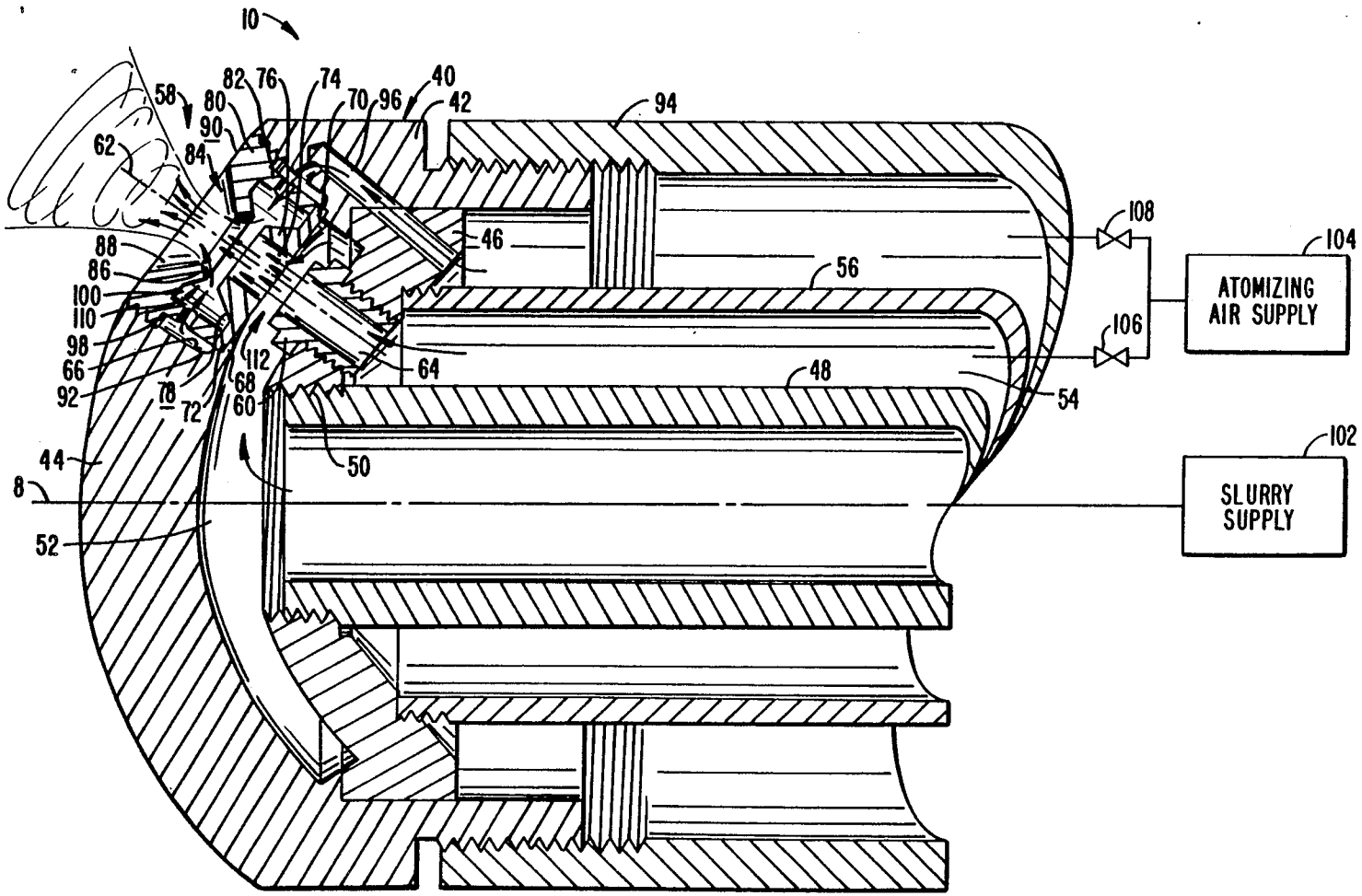
FIG. 2 is a side elevational, fragmentary cross-sectional view, on an enlarged scale, of a slurry atomizing nozzle constructed in accordance with the present invention and utilized in the burner shown in FIG. 1.

Turning now to the detailed construction of the burner and referring particularly to FIGS. 1 and 2, nozzle 10 is defined by a housing 40 which has a cylindrical, tubular section 42 and a closed end cap 44 that faces in a downstream direction. An internal insert 46 is disposed within the housing and suitably secured thereto with bolts, pins or the like (not shown). The insert has a threaded, central aperture to which a slurry supply pipe 48 is secured, for example, with threads 50. The downstream facing end of the insert is spaced apart from the end cap 44 of the housing to define a generally disk-shaped slurry flow space 52 which communicates with the slurry supply pipe and which extends radially outward to approximately the cylindrical housing portion 42.

A slurry atomizing gaseous medium, such as air, steam or natural gas, for example (hereinafter "atomizing air") is fed to the nozzle through an annular space 54 between the slurry pipe 48 and an inner air supply tube 56 the downstream end of which is threaded to an upstream facing end of internal insert 46. A plurality of slurry atomizing orifices 58 are formed in the nozzle.

Each atomizing orifice is defined by an air inlet nipple 60 threaded into the internal nozzle insert 46 concentric with an orifice axis 62. The nipple includes a central atomizing air hole 64.

An outward opening, generally cylindrical recess 66 in the end cap is concentric with orifice axis 62 and includes, at its inner end, an inwardly protruding, ring-shaped lip 68. A circular groove 72 in the lip positions a disk 70 concentrically with the orifice axis 62. The disk has a central aperture 74 that is coaxial with air hole 64 in nipple 60 and which extends through a center section 76 of the disk that has an increased thickness relative to the remainder of the disk. The center section has a frustoconical shape and includes a conical side surface 78 which converges in a downward direction for purposes more fully described below.

An orifice plate 80 is threaded into the end cap recess 66. It includes an annular skirt 82 which engages a peripheral portion of disk 70 and firmly seats the disk in groove 72 of lip 68 to thereby secure the disk in the end cap.

The orifice plate has an opening 84 which is coaxial with aperture 74 in disk 70 and air hole 64 in nipple 60. A first, frustoconically shaped upstream section of 86 of the opening converges in a downstream direction from the side of the orifice plate facing disk 70. A second, frustoconically shaped downstream section 88 of the opening is contiguous with the first section and diverges in a downstream direction to a discharge port defined by the orifice plate at the outer face 90 thereof.

Skirt 82 of the orifice plate has a lesser diameter than the inner wall of end cap recess 66 to define an annular auxiliary air supply chamber 92 between the skirt and the recess wall. The air chamber communicates with an auxiliary air intake pipe 98 threaded to the upstream end of nozzle 10 via a bore 96. The skirt includes a plurality of air inlet openings 98 which discharge the air into a ring-shaped air supply chamber 100 between the disk 70 and the orifice plate 80. The orifices are positioned so that the air is discharged into the ring-shaped chamber in a tangential direction to induce rotation of the air about the orifice axis 62.

In use, the slurry pipe 48 is conventionally connected to a slurry supply 102 and the inner and outer air tubes 56 and 94, respectively, are coupled to an atomizing air supply 104 via independently operable air flow control valves 106, 108. The air valves are manually or automatically operated as is most suitable for a particular installation.

When valve 106 is opened, atomizing air flows through the annular space 54 and hence through air hole 64, disk aperture 74, and orifice plate opening 84 of each atomizing orifice 58 to the exterior of the nozzle, that is into the combustion chamber of the furnace. When valve 108 is opened, auxiliary air flows along auxiliary (outer) air pipe 94, through bore 96 and annular space 92 into tangentially oriented inlet openings 98 in skirt 82 and hence into the ring-shaped chamber 100 where the auxiliary air swirls about the orifice axis. From there the auxiliary air flows through a cylindrical slit 110 defined between the opposing faces of disk 70 and orifice plate 80 into the orifice plate opening 84 in a manner further described below.

Slurry flows from the slurry supply 102 through slurry pipe 48 into the disk-shaped slurry flow space 52. It fills the flow space and, therefore, flows under pressure through a cylindrical slit 112 defined between opposing faces of air inlet nipple 60 and disk 70 in a radially inward direction (relative to orifice axis 62). The atomizing air flow from air hole 64 to disk aperture 74 shears off the radially inwardly flowing slurry and atomizes it. Thus, a mixture of atomizing air and slurry particles flows through disk aperture 74 towards the discharge end of orifice 58 at outer orifice plate surface 90.

The swirling air flows in ring chamber 100 through air slit 110, envelopes the mixture flow issuing from disk aperture 74 and imparts a rotating motion to it. Further, the converging (upstream) section 86 of the orifice plate opening 88 constricts the rotating mixture flow in a venturi-like manner downstream of the converging section and generally within the confines of the diverging section 88 of the opening as is illustrated in FIG. 2. As the swirling slurry-atomizing air mixture propagates in a downstream direction past the point of maximum constriction, it diverges to define the earlier discussed spray cone 22.

The frustoconical surface 78 of disk 70 has an angular inclination which corresponds to the converging, angular inclination of hole section 86 in the orifice plate. This helps to directionalize the swirling air in ring chamber 100 in a converging fashion into the orifice plate opening and thereby facilitates the constriction and subsequent conical expansion of the mixture flow into the combustion chamber. In a presently preferred embodiment the angular inclination of these two surfaces is approximately 45°.

To minimize or eliminate abrasion damage to the nozzle from high speed solid fuel particles, those parts of the nozzle which can come in contact with them, e.g. disk 70, are preferably constructed of an abrasion resisting material such as carbide or ceramic.

Flow control valves 106, 108 are employed to adjust the flow rates for both the atomizing air and the auxiliary air. The valves also permit an adjustment of the relative flow rates so that the angle of spray cone 22 can be modulated to take into account differing operating conditions, variations in the burner load, etc. Alternatively, for a constant burner operation the atomizing air and the auxiliary air can utilize a common air supply. In such an event, the inner air tube 56 is dispensed with and the atomizing air supply is directly coupled to air pipe 94, with or without a flow control valve as may be desired.

Figure 3:
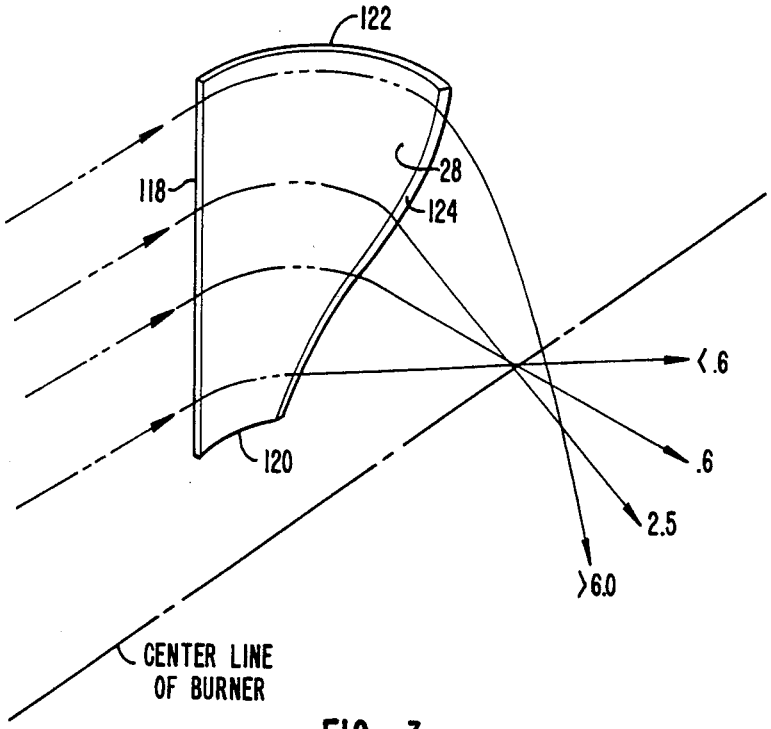
FIGS. 3 and 4 are fragmentary, schematic side elevational views of vanes constructed in accordance with the present invention and utilized in the combustion air spinner shown in FIG. 1.
Figure 4:
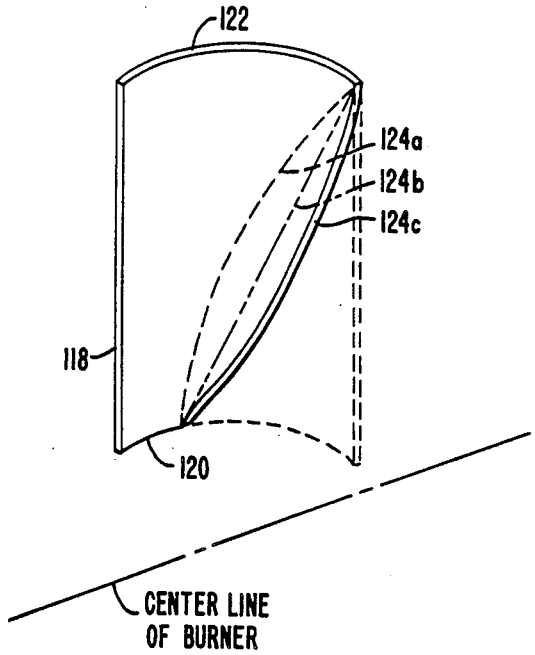

Turning now to FIGS. 1, 3 and 4, the construction and operation of spinner 12 will be set forth in detail. The spinner has inner and outer, cylindrical and radially spaced apart housing sections 114, 16 between which a multiplicity of radially oriented spinner vanes 26 are mounted. The spinner housing is suitably mounted to the furnace, in the illustrated embodiment to the cone-shaped divider 16. The inner housing section 114 suitably supports atomizing nozzle 10.

Each vane has a straight, upstream facing edge 118 and a circularly arcuate or a partial cylindrical shape in the direction of air flow, that is about an imaginary radially oriented axis (not shown), as is best illustrated in FIG. 3. The length of the vanes varies in the flow direction; it is shortest at the radially innermost vane end 120 and longest at the radially outermost vane end 122. Thus, a rotational component is imparted to air flowing over the vanes, which is customarily measured in "spin numbers." As used in the industry, the spin number is defined as the ratio of the air's rotating momentum over its axial momentum.

In a presently preferred embodiment of the invention, each vane is constructed so that a spin number of less than 0.6, e.g. 0.4, is imparted to air flowing over the vane immediately adjacent its radially innermost edge 120 while a spin number of at least 6 and preferably in the range of between about 6–12 is imparted to air flowing past the vane immediately adjacent its radially outermost edge 122. The distribution of the spin numbers between the radial extremes of the vane can be adjusted to suit specific applications. Thus, a downstream edge 124 of each vane can be given a concave, straight or convex configuration 124*a*, 124*b* or 124*c* as is schematically illustrated in FIG. 4 to suitably adjust the spin numbers.

As the foregoing discussion illustrates, the vanes 28 are constructed so that the arc through which incoming combustion air is deflected varies between the radial extremes of the vanes. It is least adjacent the radially innermost edge 120. For a spin number of approximately 0.4 the deflecting vane arc for the air is in the range of between about 10°–30°. For a spin number at the radially outermost edge 122 in the range of between about 6–12 the air is deflected through an arc of between 75°–90°. The arc deflection for the air between the radial extremes of the vane varies accordingly. In one embodiment the spin number about one-third from the inner vane edge 120 is approximately 0.6 and the arc deflection for the air is between about 30°–50°. At about two-thirds from the radially inner edge 120 the desired spin number is 2.5 and the arc deflection is between about 55°–60°.

Turning now to the overall operation of the burner 2 of the present invention and referring to FIGS. 1–4, slurry is flowed from slurry supply 102 to nozzle orifices 58 and atomizing air valves 106, 108 are opened to flow atomizing air and auxiliary air to the orifices in the above-described manner. As a result, multiple atomized slurry cones are generated by the nozzle. The above-described relatively wide cone angle of about 30° minimizes or eliminates slurry particle agglomeration which could result if the cone angle is too small and the particle density within the cone is relatively large.

To prevent slurry particle agglomeration due to contact between the spray cones from adjacent nozzle orifices 58, it is preferred to alternatingly angularly offset the orifice axes 62, say by about 10°. Aside from reducing agglomeration, the alternating angular offset of the orifices provides space between the spray cones which permit the penetration of combustion air from spinner 12 to assure a sufficient oxygen supply for the coal particles and an efficient combustion.

Combustion air enters spinner 12 from conduit 26 and is rotated about the axis 8 of the burner by spinner vanes 28. Because of the above-discussed vane shape and distribution of spin numbers, air flowing proximate the burner axis is deflected a relatively small amount as compared with the deflection of the air towards the periphery of the spinner. As a result, air flowing along the center of the spinner encounters a relatively lesser flow resistance than peripheral portions of the air and, therefore, there is a relatively larger air flow rate at the center, particularly as compared with prior art spinners which did not seek to provide relatively low spin numbers at the center of the spinner.

The relatively high spin numbers of the spinner at the peripheral portions thereof generate a low pressure gradient downstream of the spinner and radially outward of the burner axis. The low pressure gradient is schematically illustrated by generally elliptical dotted lines 126 in FIG. 1. It should be understood, however, that the elliptical lines are not meant to and do not indicate a confined, stationary low pressure zone; rather, they are shown only to illustrate the general location of the low pressure gradient. The exact position of the low pressure gradient is a function of the average spin number of the spinner measured from the center to the periphery thereof, as well as the specific distribution of spin numbers as above-discussed. Generally, the low pressure gradient will move radially further outward as the spin numbers are increased, that is as the rotational movement imparted to the combustion air flowing through the spinner is increased.

The importance of the low pressure gradient in the combustion air emitted by the spinner is that it pulls the relatively large air flow at the center of the spinner in a radially outward direction a short distance downstream of the spinner. Thus, while the center air flow prevents the combustion gas recirculation zone from reaching far enough back to contact and interfere with the operation of the fuel discharge nozzle, it nevertheless permits it to extend back as far as possible while preventing undesirable fouling. Extending the recirculation zone that far back is desirable because it assists in the rapid heat transfer to the slurry particles, the quick evaporation of the liquid therein, and a heating of the particle to and above the flash point to initiate combustion.

Lastly, in most applications it will be desirable or necessary to provide a secondary combustion air flow through register 14 which forms an air envelope about the primary combustion air and the slurry spray cones to both limit the diameter of the flame downstream of the burner and prevent slurry particles from impacting on the furnace walls. The vanes 36 of the secondary register are adjustable so that the air can be co- or counter-rotated relative to the rotation of the air emitted by the main combustion air spinner to permit the control of the flame diameter.

We claim:

1. A method of atomizing a fuel having a liquid component comprising the steps:

forming a flow of a first atomizing gas;

directing the fuel towards the atomizing gas flow in a direction approximately perpendicular thereto;

contacting substantially the entire periphery of the gas flow with the fuel to thereby shear the fuel into the gas flow, disperse it therein and form a fuel-atomizing gas mixture;

enveloping the mixture with a second gas rotating about a flow axis of the mixture; and discharging the mixture with the rotating gas flow into a combustion zone;

whereby the rotating gas flow causes the mixture to spin about the flow axis and to diverge about the flow axis as it propagates into the combustion zone.

2. A method according to claim 1 wherein the first and second gases are different gases.

3. A method according to claim 1 wherein the first and second gases are air.

4. A method according to claim 1 including the step of converging the rotating gas flow towards the flow axis prior to the step of discharging to facilitate diverging the mixture as it propagates into the combustion zone.

5. A method according to claim 4 including the step of varying the flow rate of the second gas relative to the flow rate of the first gas to thereby vary the extent to which the mixture diverges as it propagates into the combustion zone.

6. A method according to claim 1 including the step of varying the relative flow rates of the first and second gases to thereby vary the extent to which the mixture diverges as it propagates into the combustion zone.

7. A method according to claim 1 including the step of shearing a pulverized solid fuel in the liquid component.

8. A nozzle for atomizing a fuel having a liquid component into a combustion chamber comprising:

orifice means defining a substantially linear passage for atomizing air ending in a discharge port and including first and second, spaced apart intake slits surrounding and communicating with the passage;

fuel conduit means for flowing the fuel to the first slit so that it contacts the air flowing in the passage in a direction transverse thereto whereby the air flow shears off the fuel at the first slit and forms an atomized fuel-air mixture flow;

an auxiliary air conduit in fluid communication with the second slit arranged for enveloping the mixture flow passing the second slit with auxiliary air; and means for rotating the auxiliary air flow about an axis of the mixture flow to impart rotation to the mixture flow;

whereby the mixture flow diverges in a cone-shaped pattern after it leaves the discharge port and as it propagates into the combustion chamber.

9. A nozzle according to claim 7 wherein the orifice means includes a flow constrictor disposed downstream of the second slit and shaped to converge the rotating auxiliary air flow towards the mixture flow axis to effect a venturi restriction of the mixture flow and facilitate the formation of the diverging cone-shaped pattern prescribed by the mixture flow after it leaves the discharge port.

10. A nozzle according to claim 8 wherein the orifice means includes a member disposed downstream of the second slit and having a central aperture for passage of the mixture flow therethrough, the member further including a generally cone-shaped surface concentric with the aperture and converging in a downstream direction for converging the auxiliary air flow downstream of the second slit to facilitate the formation of the diverging, cone-shaped pattern prescribed by the mixture flow after it leaves the discharge port.

11. A nozzle according to claim 8 wherein the means for rotating comprises a ring-shaped chamber disposed about the second slit and at least one auxiliary air inlet opening communicating with the ring-shaped chamber and oriented to direct the auxiliary air tangentially into the chamber relative to a circle substantially concentric with the mixture flow axis.

12. A nozzle according to claim 11 including means for adjusting the relative rates of flow for the atomizing air and for the auxiliary air to thereby enable an adjustment of the diverging atomized fuel spray cone angle downstream of the discharge port.

13. A nozzle for atomizing a pulverized fuel slurry comprising:

a generally tubular housing having a closed downstream end;

means for connecting a slurry supply pipe to the housing so that an end of the pipe is spaced from the housing end;

means for connecting the housing to an air supply pipe so that an end of the air supply pipe is spaced apart from the housing end;

wall means defining a first slurry flow spaced between the housing end and the slurry supply pipe, an air flow space and for separating the slurry flow space from the air flow space; and a plurality of slurry atomizing orifices carried by the housing, each orifice being angularly inclined relative to an axis of the housing and including:

(i) first, second and third means defining a passage for an atomizing air flow passage from the air flow space past the slurry flow space, past the housing and to the exterior thereof;

(ii) the first and second means forming a slurry intake slit surrounding the periphery of the air flow so that the slurry can penetrate the air flow and be atomized thereby to form an atomized slurry-air mixture flow through the second and third means;

(iii) the second and third means defining an air envelope slit disposed downstream of the slurry intake slit and surrounding the periphery of the mixture flow;

(iv) means defining an auxiliary air intake chamber surrounding the air intake slit and an auxiliary air inlet opening communicating with the air intake chamber and oriented to discharge auxiliary air into the chamber so that the auxiliary air rotates in the chamber about an axis of the mixture flow; and (v) the third means including a constrictor which extends from the air envelope slit in a downstream direction and which converges towards the mixture flow axis;

whereby the auxiliary, rotating air enveloping the mixture flow from each orifice causes a rotation of the mixture flow and a divergence about its axis and an initial constriction of the mixture flow in a cone-shaped pattern substantially concentrically about the mixture flow axis and downstream of the atomizing orifice.

14. A nozzle according to claim 13 wherein the first and second means are defined by members constructed of an abrasion-resistant material and secured to one of the housing and the wall means.

15. A nozzle according to claim 13 wherein the first means is defined by a bushing secured to the wall means and having a downstream face which is disposed within the slurry flow space.

16. A nozzle according to claim 13, wherein the second and third means are generally disk-shaped members carried by the housing.

17. A nozzle according to claim 16, wherein the third member is threaded into the housing, and including spacer means between the disk-shaped members maintaining the first and second means in spaced apart relationship.

18. A nozzle according to claim 17, wherein the disk-shaped member defining the second means includes an aperture the upstream end of which communicates with the slurry flow space and the downstream end of which faces the member defining the third means and is spaced therefrom, and a surface converging in a downstream direction and disposed concentrically about the opening.

19. A nozzle according to claim 18 wherein the converging surface has a frustoconical shape, has an angle substantially the same as the angle of the converging surface in the third means.

20. A nozzle according to claim 19 wherein the constrictor is defined by a converging conical wall which is substantially parallel to the converging surface.

21. A nozzle according to claim 13 including means permitting an adjustment of at least one of the flow rate for the atomizing air flowing through the first means and the flow rate of the auxiliary auxiliary air flowing through the envelope slit.

22. A burner for firing pulverized fuel slurries in a combustion chamber comprising:

a fuel atomizing nozzle including a plurality of spaced apart fuel atomizing orifices from which atomized fuel slurry is discharged in a downstream diverging, conical pattern, each orifice having an axis which is angularly inclinded relative to a longitudinal burner axis and which further comprises:

(i) means defining an atomizing air flow passage including first and second, spaced apart slits which peripherally surround atomizing air flowing in the passage;

(ii) means for flowing the slurry to the first slit so that the atomizing air flowing in the passage contacts the slurry and atomizes it to generate a atomized slurry-air mixture flow;

(iii) means for introducing into the second slit an auxiliary air flow which rotates about the orifice axis and which envelopes the mixture flow to impart rotation thereto; and (iv) means for converging the mixture flow and the enveloping auxiliary air flow downstream of the second slit to generate a venturi effect and facilitate the conical expansion of the mixture flow downstream of the orifice and into the combination chamber;

a housing concentrically surrounding the nozzle for the flow of combustion air therethrough and into the combustion chamber;

a plurality of vanes carried by the housing and extending generally radially outwardly from the vicinity of the nozzle, each vane having:

(i) an upstream edge which is generally perpendicular to the burner axis;

(ii) a circularly arcuate shape in the direction of the burner axis; and (iii) a length in the direction of the circularly arcuate shape which is least proximate the nozzle and greatest at a periphery of the vane and which is selected so that the spin number of combustion air issuing from the vane increases from a point proximate the nozzle to the periphery of the spinner by a factor in the order of at least about 10;

whereby the air flow rate over the radial extent of the spinner is substantially uniform, a pressure gradient is formed downstream of the spinner and radially outward of the burner axis which draws the combustion air flow downstream of the spinner radially outwardly to form a vortex zone downstream of the burner and substantially concentric with the burner axis into which combustion gases are drawn while combustion air issuing from the spinner proximate the nozzle prevents recirculating combustion gases in the vortex zone from contacting and fouling the nozzle.

23. A burner according to claim 22 including an annular secondary air register surrounding the spinner, the secondary air register including a multiplicity of blades oriented to envelope the combustion air issuing from the spinner and the atomized fuel slurry discharged from the nozzle.

24. A burner according to claim 23 including means for varying the angularity of the blades relative to the burner axis to impart a rotational component to the secondary air stream and thereby control the extent to which the combustion air issuing from the spinner can radially expand downstream of the burner.

25. A burner according to claim 24 including means for varying the relative air flow rates for the atomizing air flow and the auxiliary air flow for adjusting the angle of an atomized fuel discharge cone formed downstream of the nozzle.

26. A burner according to claim 22 wherein the angular inclination of at least one orifice axis differs with respect to the angular inclination of at least one other orifice axis to limit contact between slurry particles discharged by the orifices.

27. A nozzle for atomizing fuel having a liquid component into a combustion chamber comprising:

an orifice defining substantially linear central passage for an atomizing gas, ending in a discharge port and including first and second, spaced apart intake slits substantially completely surrounding and communicating with the passage;

fuel conduit means for flowing fuel to the first slit so that is contacts the gas flowing in the passage in a direction transverse to the fuel flow and over substantially the entire periphery thereof, whereby the gas flow shears off the fuel at the first slit and forms an atomized fuelgas mixture flow; and a ring-shaped chamber disposed about the second slit and an auxiliary gas inlet opening communicating with the ring-shaped chamber and oriented to connect the auxiliary gas tangentially into the chamber relative to a circle substantially concentric with the mixture flow axis so that the auxiliary gas rotationally envelopes the mixture flow passing the second slit;

whereby the rotating auxiliary gas facilitates the divergence of the mixture flow in a cone-shaped pattern after it leaves the discharge port and as it propagates into the combustion chamber.

* * * * *